United States Patent [19]

Kücherer

[11] Patent Number: 5,012,970

[45] Date of Patent: May 7, 1991

[54] CAP WITH CUTTING RING FOR COMPOSITE CONTAINERS

[75] Inventor: Helmut Kücherer, Schriesheim, Fed. Rep. of Germany

[73] Assignee: Weidenhammer Packungen KG GmbH & Co., Hockenheim, Fed. Rep. of Germany

[21] Appl. No.: 287,484

[22] Filed: Dec. 20, 1988

[51] Int. Cl.[5] ..... B65D 41/04

[52] U.S. Cl. ..... 229/4.5; 220/289; 222/562; 222/321; 229/5.5

[58] Field of Search ..... 222/327, 321, 394, 402.1, 222/562, 551, 548, 549; 229/4.5, 5.5; 220/288, 289

[56] References Cited

U.S. PATENT DOCUMENTS

| | | | |
|---|---|---|---|
| 1,318,928 | 10/1919 | Shields | 222/327 |
| 2,102,666 | 12/1937 | Annen | 229/5.5 |
| 2,115,591 | 4/1938 | Sherbondy | 222/327 |
| 2,117,407 | 5/1938 | Davis | 220/288 |
| 2,122,746 | 7/1938 | Kernahan | 229/5.5 X |
| 2,412,004 | 12/1946 | O'Brien | 229/4.5 X |
| 2,467,182 | 4/1949 | Beattie | 229/5.5 X |
| 2,638,261 | 5/1953 | Poole | 229/5.5 |
| 3,272,401 | 9/1966 | Fendler et al. | 222/386 X |
| 3,721,370 | 3/1973 | Blum . | |
| 3,734,393 | 5/1973 | 73Stump | 229/5.5 |
| 3,986,644 | 10/1976 | Grogan . | |
| 4,059,201 | 11/1977 | Foster . | |
| 4,109,820 | 8/1978 | Stifano | 229/5.5 X |
| 4,138,036 | 2/1979 | Bond . | |
| 4,163,517 | 8/1979 | Kappler et al. | 229/4.5 |
| 4,225,053 | 9/1980 | Naugle et al. | 229/4.5 X |
| 4,241,864 | 12/1980 | Kessler | 229/5.5 X |
| 4,456,153 | 6/1984 | Meshberg . | |

FOREIGN PATENT DOCUMENTS

| | | |
|---|---|---|
| 1718545 | 4/1954 | Fed. Rep. of Germany . |
| 925216 | 3/1955 | Fed. Rep. of Germany . |
| 6900925 | 4/1969 | Fed. Rep. of Germany . |
| 3517122 | 5/1986 | Fed. Rep. of Germany . |
| 2085207 | 12/1971 | France . |

*Primary Examiner*—Kevin P. Shaver
*Attorney, Agent, or Firm*—Bachman & LaPointe

[57] ABSTRACT

A package for dispensing products capable of fluid motion consists of a container which receives the product, a closure and a re-usable dispensing facility that has a cap which can be fitted onto the container in a sealed manner after opening the closure. The container consists of a sleeve of composite cardboard or paper material preferably with at least one layer that is a barrier to liquids and one sealable plastic layer at least on the inside. The container further consists of a bottom sealed onto the sleeve and a closure membrane which can be wholly or partially opened, sealed to the container at an opposite end. The dispensing facility can be fixed on to the end face of the sleeve by the cap.

13 Claims, 4 Drawing Sheets

CAP WITH CUTTING RING FOR COMPOSITE CONTAINERS

BACKGROUND OF THE INVENTION

The invention relates to a package for dispensing products capable of fluid motion, consisting of a container receiving the product, having a closure and a re-usable dispensing facility which features a cap that, after the closure has been opened, can be fitted onto the container in a sealed manner A large number of products capable of fluid motion e.g. dry-pourable, liquid and pasty products are today offered in packages from which they can be directly dispensed, dispersed, expressed or sprayed in desired amounts. Examples which may be mentioned are cosmetics, medicaments, foodstuffs and flavouring agents, cleaning and personal health care agents as well as paints and varnishes. Widespread use has been gained in this context by aerosol cans, which are designed as sealed packages of metal or plastic and contain along with the actual consumer product a propellent gas or a gas-generating compound. In many cases use has also been made of dispensing facilities in the form of mechanical spray devices that function after the fashion of a pump, without propellent gas. These are fitted onto the container which consists of glass, plastic or metal. For this purpose, the container has a neck with external thread onto which a spray device cap with internal thread is placed and screwed in a sealed manner onto the container. The spray device has, furthermore, a dip tube which reaches as far as the bottom of the container. By means of a pump which can be operated by the fingers, in particular by the thumb, the liquid is sucked in or forced into the dip tube and fed to the atomization nozzle.

It is furthermore known, in particular for the dispensing of pasty products, to provide the dispensing device, likewise operating in the manner of a pump, as a reusable part and, once a container has been emptied, to screw it onto a new, filled container. In this case, however, there is no atomizing dispensing but a portioned dispensing of the product.

All known packages of the design mentioned above have the disadvantage that at least the container consisting of plastic, metal or glass has a large space requirement in waste disposal and cannot be recycled, or only with considerable effort. The raw materials for the production of such containers are also relatively expensive, or the energy costs necessary for their production are very high.

In the case of complex and expensive spraying instruments e.g. paint and varnish spray guns, it is known (DE-C-35 17 122) to provide the spray device with a receptacle which accommodates a container holding the fluid to be sprayed. The container is in the form of a one-way disposable package of plastic or cardboard. The receptacle features a piercing means with suction bore, and the container inserted in the receptacle in such a way that the piercing means penetrates the end of the container thus allowing the fluid to flow into the spray gun. By this means it is not possible to produce a fluid-tight seal. In another version which enables a tight seal to be formed, the container features at its base a valve of complex design that can be opened by the piercing means of the receptacle. Because of the complex design of the valve, the container is expensive and should therefore be re-usable i.e. refilled, which calls for an appropriate design of the container lid.

SUMMARY OF THE INVENTION

The object of the invention is to create a package of the kind described at the beginning in such a way that it can be manufactured at favourable cost and can be used equally well with complex and with functionally optimised dispensing facilities. Furthermore it is intended that the package, after consumption of the product, can for the greater part be directed for unproblematic waste disposal or for recycling. Also the container should be designed in such a manner that it can be combined with any form of dispensing facility, possibly of complex construction and, independent of contents, permits proper, complete emptying.

This object is achieved according to the invention in that the container consists of a sleeve of composite cardboard or paper material and at least one sealable plastic layer on the inside, a bottom that is sealed onto the inner side of the sleeve, and a closure membrane that is sealed onto the other end of the sleeve and can be partially or wholly opened, and in that the dispensing facility can be secured to the end of the sleeve by means of the cap.

Although packages out of composite cardboard containers are used in large numbers, they primarily serve for the packaging of pourable products, such as powder or the like, or else doughy to pasty products, such as jams etc., more rarely for liquids, such as juices or the like. Due to their lack of dimensional stability and the difficulty of attaching a releasable, but at the same time sealed closure, such composite cardboard or paper containers have hitherto not been used for packages with dispensing facilities, in particular controlled supply or spraying devices or the like. The problem of attaching a releasable closure, or even a dispensing device, for example a spraying or pumping device, also arises from the fact that the sleeve consisting of the cardboard or paper composite is designed with the same cross-section over its entire height and cannot be provided with an external thread or the like in order to be able to fit the dispensing or spraying device. This is where the invention effectively provides a remedy in that the container does not have a releasable closure but instead a sealed-on closure membrane with an opening that is broken open wholly or partially only when being put into use, while the cap of the dispensing facility can be fixed onto the end face of the container.

The packaged product can thus be stored and offered in a tightly sealed container of the simplest and most inexpensive design, and the dispensing facility can be brought into connection with the container without any problems. Once the container has been emptied, the dispensing facility can be removed and fitted onto a new container with sealed-on closure membrane. The dispensing facility is thus reusable, while the emptied container is discarded. Due to its low dimensional stability, in particular in the emptied state, the container can be crushed without problem and thus takes up little space. In waste disposal, for example in refuse incineration plants, the greatest part of the container viz., the entire sleeve of cardboard or paper composite material can be burned and converted into thermal energy.

The dispensing facility can be in the form of a manually operated control feed device e.g. in the form of a dispersing device, a spraying device or the like. In the case of liquid or pasty contents the sleeve of cardboard or paper composite material is provided with a, for example metallic, barrier layer e.g. in the form of a metal foil. In that case it is furthermore provided for the dispensing facility to be a spray device with a hand pump having a dip tube that reaches almost to the bottom of the container.

A preferred version is such that the closure membrane features a prepared opening that can be broken open. This opening is broken open before or during the joining of the dispensing facility to the container so that the contents can be removed by the dispensing facility.

The closure membrane and/or the bottom can consist of a metal foil with at least one sealable plastic layer arranged on the inside. This version has the advantage that the container has little weight and can be made such that it is air-tight i.e. does not allow fluids or gases (aromas) to escape.

Instead it can be provided that the closure membrane and/or the bottom consists of composite cardboard or paper material having at least one sealable plastic layer arranged on the inside. As a result the metal fraction is reduced further and the combustible fraction for energy recovery disposal increased. For those cases where a fluid-tight or gas-tight container is required with this version it is also possible to employ a metallic barrier layer.

The closure membrane and/or the bottom is/are preferably drawn into the sleeve and sealed outside and inside onto the sleeve.

A further advantageous version is such that the bottom of the container slopes in the form of a depression towards the center. In the case of the dispensing facility being in the form of a spray device the dip tube can reach down to the depression so that, on standing the container upright, complete emptying of the container is assured. The dip tube can, however, also terminate a distance above the depression in order to avoid sediment being sucked up the tube. Moreover this shaping of the container bottom contributes to the stabilization of the same which is important in particular if it is made of a metal foil.

As the membrane forming the container bottom should also be as thin as possible — in the range of some μm — it can be embossed essentially in a radial direction in order to stabilize the bottom and to prevent uncontrolled bulging during filling and/or shaking of the contents.

Packaging with a sleeve of cardboard or paper composite material, especially if their wall thickness is small, have the disadvantage of low shape stability. Round sleeves tend to become oval. This makes the package unattractive and makes it difficult or even impossible to mount the ejector unit. To avoid this, it is foreseen to insert in the sleeve, in front of the closure membrane at the lid end, a paperboard disc of the same shape as the cross-section of the container.

A further measure for increasing the shape stability is the insertion of a paperboard disc of the same shape as the container cross-section in front of the bottom at the bottom end of the container.

The paperboard discs can be glued, sealed or inserted in a push-fit manner. In each case, however, at least the paper-board disc on the lid end is releasably mounted and features a tab which allows the said disc to be removed before mounting the dispensing facility on the container. The sleeve is then stabilized by the cap of the dispensing facility and by the paperboard disc at the bottom, if present, also during use.

In a further advantageous development it is provided that the break-out opening on the closure membrane is stamped into the metal foil, cardboard or paper composite material and is closed off by a sealed-on foil or by the sealable plastic layer of the closure membrane lying on the inside.

In the case of known drink packages it is known to provide the container with an opening closed by a sealed-on foil, to be able, for example, to introduce a drinking straw. In the case of the design according to the invention, the sealed opening fulfils the task of receiving the dip tube of the spraying device. With an approximately same cross-section of opening and dip tube, the dip tube is additionally positioned and centered. The opening can, however, also be designed to be larger in order that on tilting the package any fluid overflowing into the space between the cap and the closure membrane can be allowed to flow back into the bulk of the container. For the same purpose it can be favorable also to provide the closure membrane with a depression.

In a preferred embodiment, it is provided that the neckless sleeve at the end with the closure membrane is widened outwards, forming a locking rim for the cap. Due to the widening of the opening on the one neckless end of the sleeve, a type of outer annular bead is produced, which serves for the fitting of the cap of the dispensing facility. In this case it is possible in particular to achieve an adequately good sealing at the locking rim to make it possible to pump out the contents by means of a spray device. It is possible, furthermore, to provide the container straight away with a dispensing facility when it is first produced so that, having purchased such a package, the consumer later need buy only individual containers with the product while the dispensing facility can be repeatedly reused.

In order to obtain a sealed closure, in particular for the initial purchase of the package with the fitted dispensing facility, in a preferred embodiment the cap has a resilient rim flange overlapping the locking rim of the sleeve on outside and inside. Such a resilient overlap makes possible on the one hand the fitting of the dispensing facility onto the container and leads on the other hand to a sealed closing-off of the rim on the inside, which prevents the escape or evaporation of the packaged product with fitted dispensing facility.

It is advantageously provided that the rim flange is formed by an annular lip bearing in a sealed manner against the sleeve on the inside and by a locking rim resiliently overlapping the sleeve on the outside.

According to a further exemplary embodiment, the sealing can be improved still further in that the rim flange has a dimensionally stable collar ring overlapping it.

Once the cap has been fitted, the dimensionally stable collar ring is pressed over the rim flange or else is screwed onto a corresponding external thread of the rim flange, so that the part of the rim flange on the outside cannot spring back and the cap is fixed firmly on the container, and consequently so is the dispensing facility. This design is also recommendable in particular whenever the container is offered with fitted dispensing facility as a retail package.

Instead of this, it may also be provided that an annular cover part of plastic is welded, stuck or injection-moulded onto the end face of the neckless sleeve, the annular opening of which cover part is closed by the closure membrane and on which the dispensing facility can be fixed with its cap.

In the case of this design, the closure membrane is thus not directly fastened to the sleeve of the container, but to the cover part. The stuck, welded or moulded-on cover part acts at the same time as a reinforcing ring for the sleeve, so that the latter can be produced with a relatively thin wall, thus saving material. The same applies whenever the cover part is moulded-on, as in this case it is also possible to use a smaller amount of material for the cover part than in separate production.

It is preferably provided that the annular cover part has a sleeve-shaped extension protruding into the sleeve of the container, by which extension it is fastened to the sleeve by welding, adhesion or injection-moulding. With this design, the sealing takes place on the inside of the container, so that the packaged product cannot penetrate to the end edge, at which there is generally a free cut edge of the composite material.

A further advantageous exemplary embodiment is characterized in that the annular cover part consists of a plastic which can be welded to the inside plastic layer. In this way, sleeve and cover part can be welded without any problems, whether by simple heating if a separately produced cover part is used or in molding-on of the cover part. Molding-on has the advantage that unevennesses in the wall of the sleeve, which there always are with composite material, in particular if the sleeve is produced by the conventional winding process, can be compensated for.

A further advantageous exemplary embodiment is characterized in that, when the package is first produced, the cap has, as originality closure, a retaining ring enclosing the sleeve on the outside and connected to the rim flange via predetermined breaking tabs.

The container designed according to the invention can comprise essentially of at least up to 75%, preferably up to 90% of recycled paper or cardboard. Consequently, not only can the container according to the invention be produced out of inexpensive used material, but can with the same large weight fraction be combusted in refuse incineration plants to recover the thermal energy content.

The invention relates furthermore to a package comprising a sleeve of composite cardboard or paper material having a sealed-on bottom and on the opposite end a sealed-on closure membrane that can be partially or completely opened, also a cap that overlaps the sleeve with closure membrane, said cap being in particular, but not exclusively, in conjunction with a dispensing facility. A cap for such a container is characterized according to the invention in that it features a rim flange in the form of a cutting ring overlapping the sleeve on the outside, which cutting ring cuts into the composite material when screwed onto the sleeve.

In the case of this design of the cap, the invention utilizes the fact that the composite cardboard or paper material is relatively soft and compliant, in particular it is also easy to deform permanently. By screwing the cap onto the sleeve, the cutting ring works into the composite material in the manner of a thread, so that the cap receives a firm seat on the sleeve. In this case, the cutting ring can, furthermore, be designed such that — even with opened closure membrane — a sealed closing-off is provided at the same time for the container. Such a cap can be used for composite cardboard or paper cylindrical containers of any design and with any filled product. It is, however, also suitable in particular for forming the previously described cap of the dispensing facility and for screwing onto the container after fitting the dispensing facility, in order to fix that facility on the sleeve. Once the container has been emptied, the dispensing facility can be removed in a similarly simple way and fitted again onto the next filled container. If the cap can be employed for closing off containers with other consumer products, then it can be re-used, while the container itself is discarded after emptying.

The cutting ring preferably has a multiple internal thread, each course of the thread expediently having a relatively large pitch in order to fix the cap on the container with one or just a few turns and to achieve a particularly effective seal.

It is furthermore of advantage for the inner thread to have an inner diameter that diminishes with increasing distance from the free end of the cap towards its interior. In conjunction with the further measure viz., that a backing ring is arranged in the interior of the cap a distance from the inner thread, and that the distance between the backing ring and the inner thread, at least in the region of the smallest inner diameter of the inner thread, is smaller than the wall thickness of the cap, a great advantage is derived in that on the one hand the screwing on of the cutting ring is made easier, and on the other hand the sleeve is squeezed between the thread and the backing ring so that a perfect seal is obtained.

In a modified embodiment it is provided that the sleeve, at least in the region overlapped by the cutting ring, features greater compliance. By this design the deformability of the sleeve can be improved in its region receiving the cap so that the cap can be screwed more easily and effectively onto the sleeve.

The above mentioned embodiment can be realized in multiple ways, for example, in that the sleeve features a greater wall thickness at least in the region overlapped by the cutting ring. Such a greater wall thickness is easiest achieved by the provision of a bandage in the region of the sleeve overlapped by the cutting ring, it being possible for the bandage to be sealed, stuck or welded onto the sleeve and possibly, to be made of a softer material.

Instead of that, it is of course also conceivable for the sleeve to feature on the outside a softer layer that, for example, is made of a thin laminate layer of foam-foil, a soft paper layer, possibly also in the form of the label material applied to the sleeve.

In order to make it easier to screw on the cutting ring it can be provided that the sleeve, on the outside in the region overlapped by the cutting ring, features entry grooves for the inner thread of the cutting ring.

If the container features a metallic closure membrane, the edge of which is sealed to the outside of the sleeve, then in specific cases it can be particularly difficult to screw the cap with the cutting ring onto the sleeve. In this case at least the membrane rim can be provided with moulded-in entry grooves for the cutting ring. These entry grooves can be formed in the sleeve and/or in the edge of the closure membrane without any difficulty by means of pressing or rolling. At the same time these entry grooves provide a means of guidance for the cap when it is being screwed on.

Instead of that or in addition the screwing-on of the cap can be made easier in that, when employing a metal closure membrane which is sealed by its rim to the outside of the sleeve, the sleeve has a smaller outer diameter over the height of this rim, and the cutting ring is greater in height than the rim of the closure membrane, so that the cutting ring cuts into the sleeve below this rim. With this embodiment therefore the cap simply overlaps the rim of the closure membrane and the cutting ring is turned, cutting into the free, exposed outer surface.

The abovementioned cap may have an annular lip bearing in a sealed manner against the sleeve on the inside. Instead of this, of course an annular seal may also be inserted into the cap in a conventional way.

The invention is described below with reference to exemplary embodiments reproduced in the drawing, in which:

Figure 1:
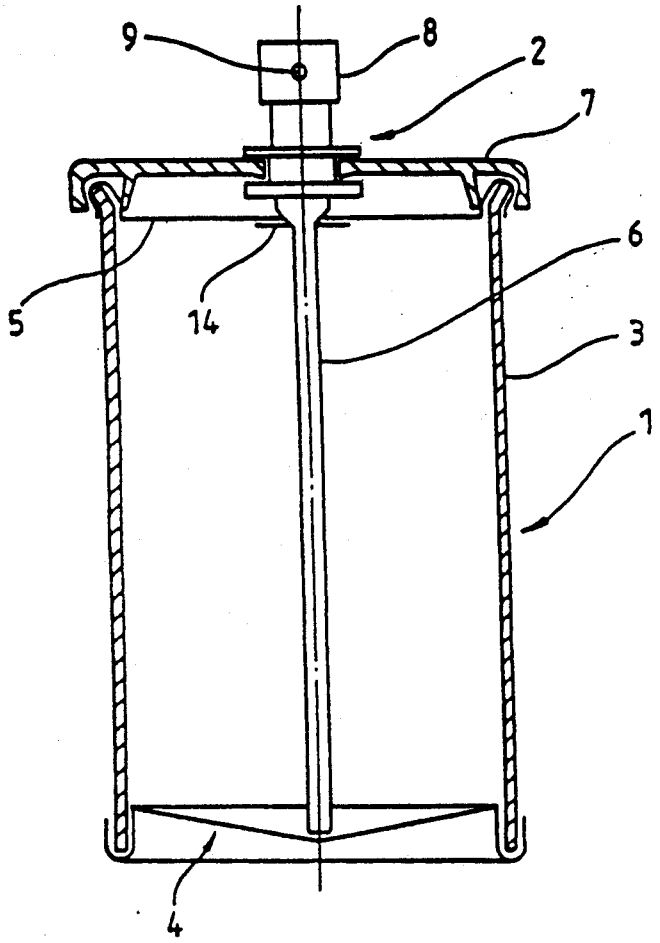
FIG. 1 shows a section through the package ready for use.
Figure 2:
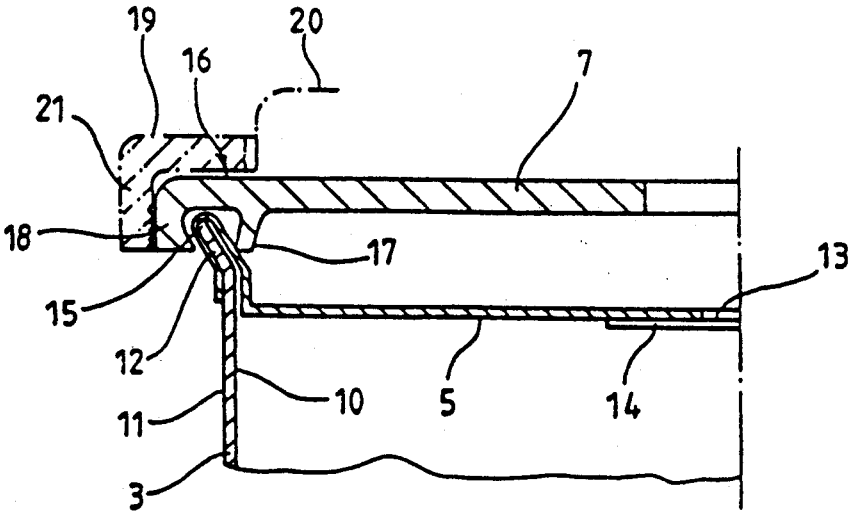
Figure 3:
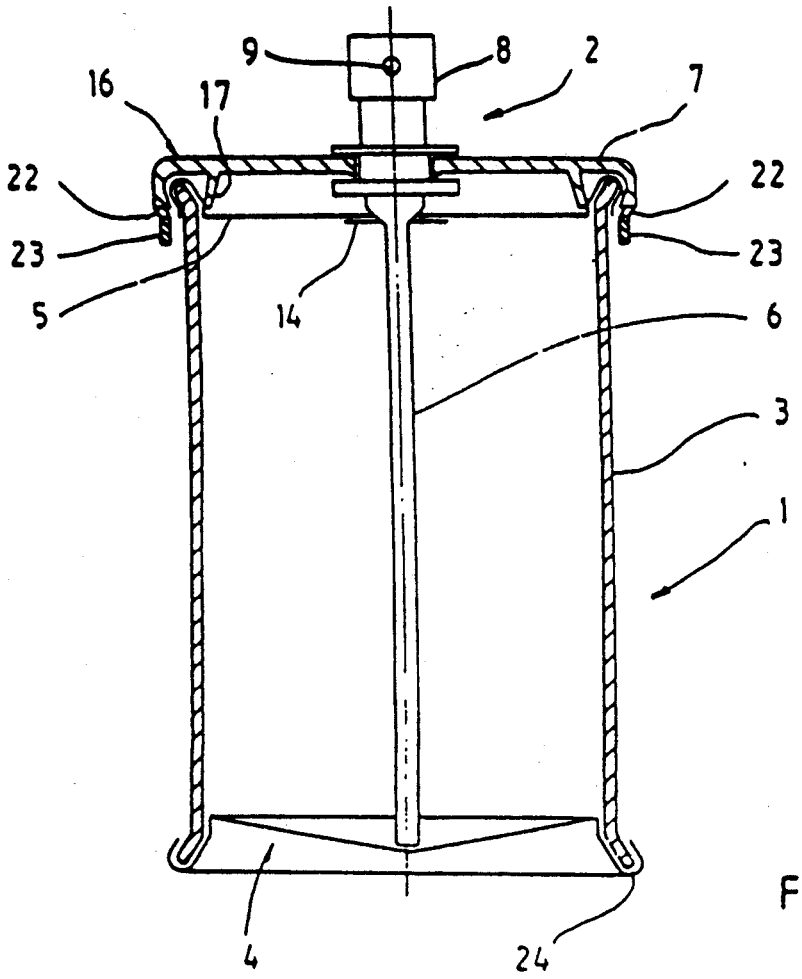
Figure 4:
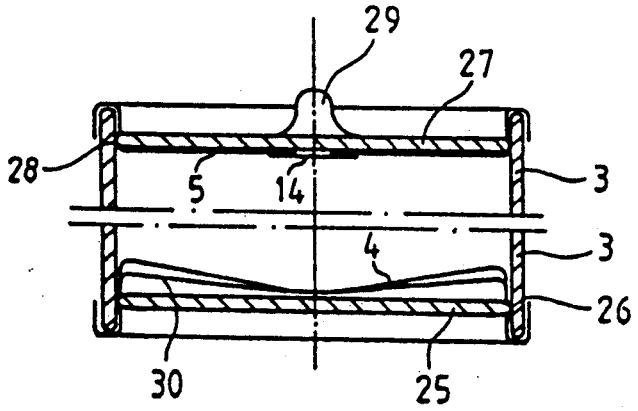
Figure 5:
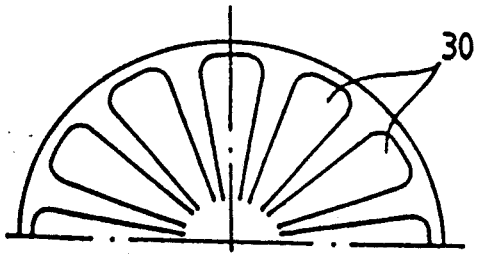

Figure shows a detail section on a larger scale in the 1*a*, *b* region of the bottom;

FIG. 2 shows a detail section in the region of the upper closure membrane:

FIG. 3 shows a representation similar to FIG. 1 of a modified embodiment;

FIG. 4 shows a broken-off representation of an embodiment of the package in original retail package form;

FIG. 5 shows a plan view of an embodiment of the bottom of the package.

Figure 6:
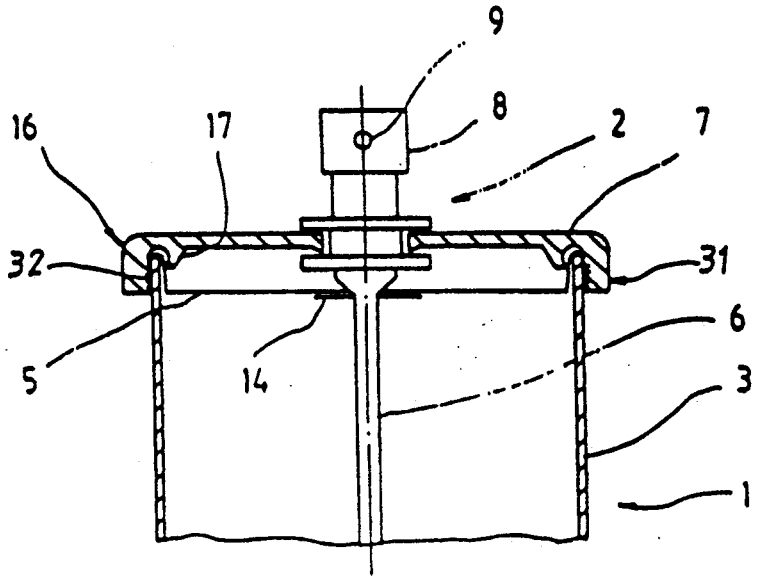
Figure 7:
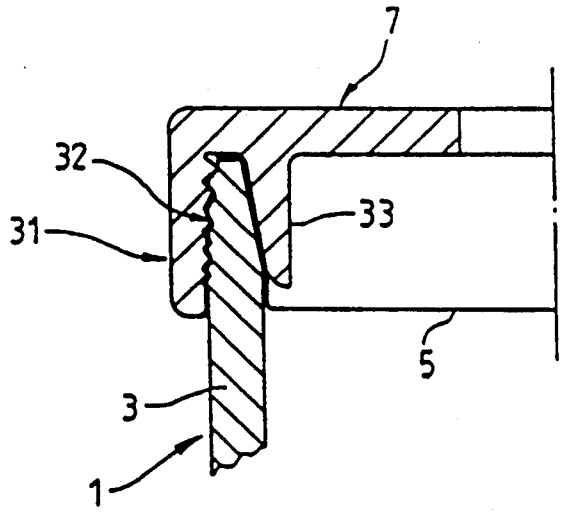
Figure 8:
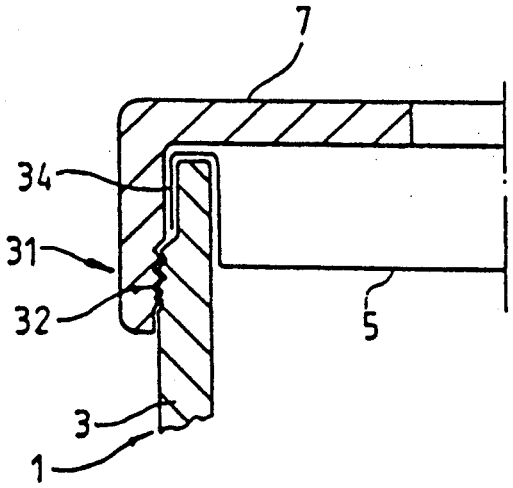
Figure 9:
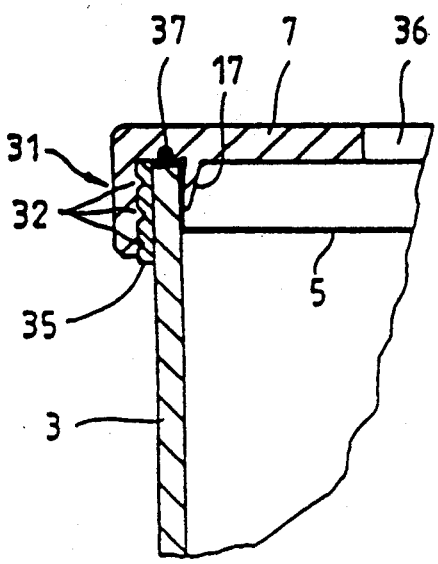
Figure 10:
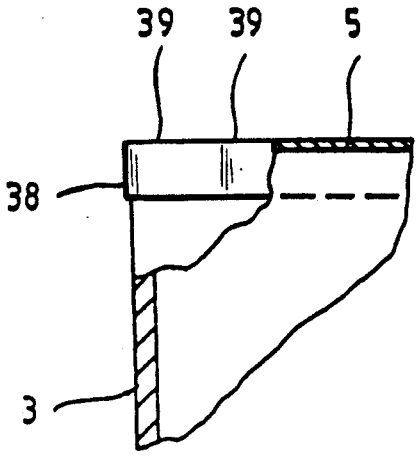
Figure 11:
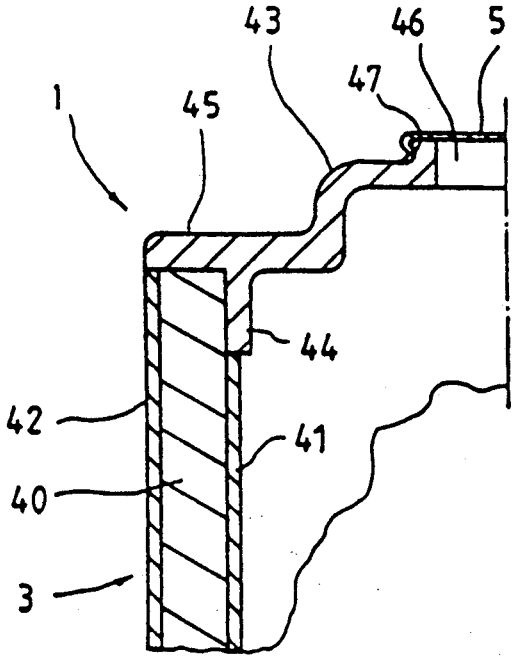

FIG. 6 shows a broken-off representation of a further embodiment of the package;

FIG. 7 shows a sectioned view of part of a package modified with respect to FIG. 6;

FIG. 8 shows another, with respect of FIG. 7, modified version;

FIG. 9 shows a sectioned view of part of a package that is a further version of the embodiment shown in figure 6;

FIG. 10 shows a sectioned view corresponding to that in FIG. 8 but featuring the closure membrane with entry grooves;

FIG. 11 shows a sectioned view of part of a package having another design.

DETAILED DESCRIPTION OF THE INVENTION

The package for products capable of fluid motion in particular liquid products, represented in FIG. 1, has a container 1 and a dispensing facility 2 in the form of a spraying device. The container 1 consists of a cylindrical, for example circular-cylindrical, oval or else of a polygonal sleeve 3, a bottom 4 and a closure membrane 5 forming the upper closure. The spraying device 2 has a dip tube 6, which reaches to the bottom of the package, and a cap 7, which is locked onto the container 1. The spraying device 2 has, furthermore, a grip 8 in the form of a pushbutton, by the activation of which a pump (not shown) is driven, which delivers the liquid in the container 1 to an atomization nozzle 9.

Figure 1A:
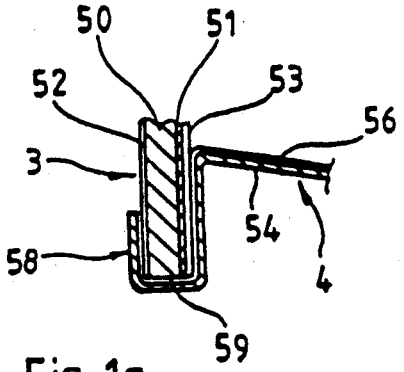
Figure 1B:
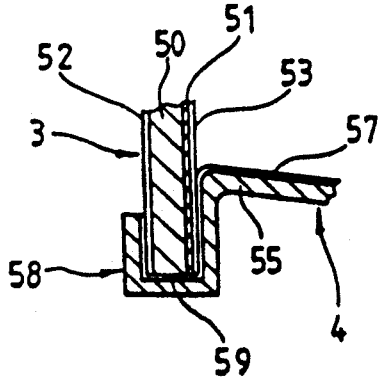

The sleeve 3 is, as shown in FIGS. 1*a* and 1*b*, produced from a possibly multi-layered composite cardboard or paper laminate 50, and in the case of liquid, pasty or moisture-sensitive contents features a layer 51 acting as a barrier to liquid, and comprising for example a metal foil. This can in turn be arranged inside, outside or within the composite cardboard or paper laminate. The sleeve 3 is provided on its inside 10, and possibly on its outside 11, with a sealable plastic coating 52 or 53, by which the bottom 4 and the closure membrane 5 can be sealed thermally or by high frequency. For this purpose the bottom 4, as FIG. 1*a* shows, and also the closure membrane 5 is produced as a deep-drawn part from a metal foil 54 or likewise from cardboard composite 55 (FIG. 1*b*) with a sealable plastic coating 56 or 57, and is flanged with its rim 58 around the end face 59 of the sleeve 3 and sealed-on, inside and outside.

The closure membrane 5 has in its centre a prepared opening 13, which is closed by a foil 14 sealed onto the rear of the closure membrane 5 and is possibly protected from the outside by a cover (not shown). Instead of the foil section 14 shown, the closure of the opening 13 may also be formed by the sealable coating of the closure membrane 5.

The end rim 12 of the sleeve 3 is, as evident from FIG. 2, bent outwards by widening of the end opening, so that a locking rim 15 for the cap 7 of the spraying device 2 is produced. For this purpose, the cap 7 has a rim flange 16, which is formed by an annular lip bearing 17 arranged on the inside and locking ring 18 arranged on the outside. The annular lip 17 is almost rigid in design in order to be able to perform a sealing function, while the locking ring 18 can spring out in radial direction, so that the cap 7 can be clipped onto the locking rim 15, the annular lip 17 in particular ensuring a sealed closure. In order to avoid a spreading-open of the locking ring 18, in particular when the complete unit comprising container 1 and spraying device 2 is offered as a retail package, a dimensionally stable collar ring 19 may be provided, which is guided on a corresponding extension 20 of the cap 7 and overlaps the locking ring 18 by a downwardly reaching annular part 21. This collar ring 1 may be designed as a sliding part or else have an internal thread, which interacts with a corresponding external thread on the locking ring 18.

In the case of the exemplary embodiment according to FIG. 3, on the rim flange 16 there is attached via predetermined breaking tabs 22 a retaining ring 23, which prevents an inopportune lifting-off of the cap 7 and at the same time serves as originality closure. In order to be able to remove and reuse the spraying device once the container 1 has been emptied, the retaining ring 23 is torn off, so that the cap 7 can be removed with the spraying device 2. As FIG. 3 further shows, the sleeve 3 is also widened at its end face at the bottom, in order to form in this way an enlarged stand ring 24, which is recommendable in particular in the case of containers having a large ratio of height to diameter.

In order to improve the low dimensional stability of the package, in particular that of the sleeve, a paperboard disc 25 can be inserted (FIG. 4), said disc for example residing securely in place by virtue of push-fit 26, or any other manner, in a groove pressed into i.e. recessed in the sleeve 3. Likewise, in the case of subsequently purchased packages without the spraying device 2, a paperboard disc 27 can be mounted on top of the closure membrane 5 and secured there by push-fit means in a prepared groove. The paperboard disc 27 must be releaseable, for which purpose it features a tab 29 for gripping; after removal of the disc the spraying device 2 can then be mounted into place.

In order for the membrane-like bottom 4 to have a better dimensional stability at small wall thickness, a radially symmetric embossment 30 can, as shown in FIG. 5, be provided in it.

FIG. 6 shows an embodiment in which the sleeve 3 at least at its upper end terminates cylindrically with the diameter of the sleeve. The cap 7 features an edge flange 16 which in turn is provided with an inner annular lip 17 that acts as a seal. The part of the cap 7 that overlaps the sleeve on the outside is, in contrast to the abovementioned embodiments, rigid and in the form of a cutting ring 31. In the version shown it features a multi-pitch inner thread 32 which on screwing the cap 7 onto the sleeve 3 cuts into the relatively soft composite material. An additional seal is provided inside by means of the annular lip 17. To make it easier to screw on, the cap 7 can be provided on the outside with a profiled surface.

FIG. 7 shows an embodiment with a cap 7 such as may be used also for other containers of the same design. It features again a cutting ring 31, however the thread 32 is, as shown in the drawing, provided with a pitch that increases in the inwards direction and inner diameter that likewise decreases. A distance from the inner lying thread is a backing ring 33. The width of the gap thus created between the backing ring 33 and the inner thread 32 decreases inwards from the free, open end of the cap, and as such narrows down to a width that is smaller than the thickness of the wall of the sleeve 3, so that the sleeve wall in the region is squeezed together on screwing on the cutting ring. This way a tight seal on the container is obtained even after multiple use. In the case of this embodiment the rim of the closure membrane terminates at the upper end of the sleeve.

In the exemplified embodiment according to FIG. 8 the sleeve features, in the region overlapped by the edge 34 of the closure membrane, a smaller outer diameter than the other regions, i.e. the outer face is recessed inwards. The cutting ring 31 is in this case arranged lower on the cap 7 so that the inner-lying thread 32 need only be turned into the material of the sleeve 3, but not into the much harder material of the closure membrane 5.

In the case of the exemplary embodiment according to FIG. 9, the cap 7 again has a cutting ring 31 overlapping the sleeve 3 on the outside and having a multiple, steep thread 32. The sleeve 3 is, however, provided in its rim region on the outside with a bandage 35, which on the one hand stabilizes the rim region, but on the other hand leads to a greater compliance and deformability in the outer region, so that the cutting ring 31 can be screwed on more easily. The cap 7 can in turn receive a dispenser insert 2 in a central hole 36. The bandage 35 may consist of the same composite material as the sleeve 3 or else of another, in particular a softer, material.

Furthermore a seal 37 can be provided between the cap 7 and the upper edge of the sleeve 3 or the rim of the closure membrane which is secured there, this in order to obtain a tight closure in the edge region when the cap is closed.

In FIG. 10, a container 1 is shown with a sleeve 3, onto the end face of which a closure membrane 5 is sealed by the closure membrane 5 being folded outwards with its rim 38 over the sleeve 3 and sealed onto the outer plastics coating of the sleeve 3. In order to make it possible also in this case to achieve an easy screwing-on of a cap 7 with cutting ring 31 entry grooves 39 may be moulded into the overlapping rim 38 of the closure membrane 5.

FIG. 11 shows an exemplary embodiment of a container 1, the sleeve 3 of which has a core 40 of possibly multiple paper or cardboard layers, possibly also with a metallic barrier layer. This core 40 is, as already described at the beginning, provided on its inside with a plastics coating 41 and possibly also on its outside with a plastics coating 42. Onto the end face of the neckless sleeve 3 is moulded the annular cover part 43, which consists of a plastic affine to the inside plastics coating 41, so that the inner coating 41 and the cover part 43 fuse together in the region of the latter's sleeve-shaped extension 44, which engages into the sleeve 3. The free face edge of the sleeve 3, in particular of the core 40, is covered in a sealed manner by an overlapping rim 45 of the cover part 43. The cover part 43 has in turn a central opening 46, which is closed by a closure membrane 5 and can serve for receiving a dispensing facility 2. For this purpose the cover part 43 features a bead 47 onto which the dispensing facility can be clipped on.

As already indicated the dispensing facility can, depending on the contents, be a spraying facility, a dispersion facility, an expressing facility or the like. The container can also serve as a refill package for mechanically operating spray and distributor facilities.

What is claimed is:

1. Package comprising a sleeve of composite cardboard or paper material having a sealed-on bottom and at the opposite end a sealed-on closure membrane which is at least partially openable, a cap that overlaps the sleeve with the closure membrane characterized in that the cap (7) features a rim flange (16) in the form of a cutting ring (31) overlapping the sleeve (3) such that the cutting ring (31) cuts into an exterior surface of the composite material as the cap (7) is screwed onto the sleeve (3).

2. Package according to claim 1, characterized in that the cutting ring (31) features a multiple pitch inner thread (32).

3. Package according to claim 2, characterized in that the inner diameter of the inner thread (32) decreases in size with increasing pitch depth towards the interior of said package.

4. Package according to claim 1 characterized in that the sleeve (3) has a greater compliance at least in the region overlapped by the cutting ring (31).

5. Package according to claim 1, characterized in that the sleeve (3) has a greater wall thickness at least one the region overlapped by the cutting ring (31) and a lesser wall thickness at an upper edge of said sleeve.

6. Package according to claim 27, characterized in that the sleeve (3) is provided with a bandage (35) in the region overlapped by the cutting ring.

7. Package according to claim 33, characterized in that the bandage (35) is sealed, stuck or welded onto the sleeve (3).

8. Package according to claim 1, characterized in that the sleeve (3) has an external layer (35) on the outside and said external layer is softer than said sleeve.

9. Package according to claim 1, characterized in that the sleeve (3) is provided, on the outside in the region overlapped by the cutting ring (31), with entry-grooves for an inner thread (32) of the cutting ring (31).

10. Package according to claim 1, characterized in that on employing a metallic closure membrane (5) which is sealed by its rim (38) to the outside of the sleeve (3), at least the rim (38) of the membrane (5) is provided with shaped entry grooves (39) for an inner thread (32) of the cutting ring (31).

11. Package according to claim 1, characterized in that, on employing a metallic closure membrane (5) that is sealed by its rim (34) to the outside of the sleeve (3), the sleeve has a smaller outer diameter over the height of this rim, and the cutting ring (31) a greater height than the rim of the closure membrane (5), so that it cuts into the sleeve (3) below this rim.

12. Package according to claim 1, characterized in that the cap (7) has an annular lip (17) bearing in a sealed manner against the sleeve on the inside.

13. Package comprising:

a sleeve (3) of composite cardboard or paper material;

said sleeve having a sealed-on bottom and at the opposite end a sealed-on closure membrane which is at least partially openable;

a cap that overlaps the sleeve with the closure membrane;

said cap featuring a rim flange in the form of a cutting ring overlapping the sleeve such that the cutting ring cuts into an exterior surface of the composite material as the cap is screwed onto the sleeve;

said cutting ring having an inner thread (32);

a backing ring (33) provided in the cap at a distance from the inner thread (32); and the distance between the inner thread (32) and the backing ring (33), at least in the region of the smallest inner diameter of the inner thread (32), is smaller than the wall thickness of the sleeve (3).

* * * * *

UNITED STATES PATENT AND TRADEMARK OFFICE

CERTIFICATE OF CORRECTION

PATENT NO. : 5,012,970

DATED : May 7, 1991

INVENTOR(S) : Helmut Kucherer

It is certified that error appears in the above-identified patent and that said Letters Patent is hereby corrected as shown below:

In column 10, claim 5, line 42, delete "one" and insert --on--.

Signed and Sealed this

Twenty-ninth Day of September, 1992

*Attest:*

DOUGLAS B. COMER

*Attesting Officer*

*Acting Commissioner of Patents and Trademarks*